US005309808A

United States Patent [19]

Tarrant

[11] Patent Number: 5,309,808

[45] Date of Patent: May 10, 1994

[54] ACOUSTIC PRACTICE MUTE

[76] Inventor: James K. Tarrant, 9722 Railton, Houston, Tex. 77080

[21] Appl. No.: 89,180

[22] Filed: Jul. 12, 1993

[51] Int. Cl.[5] ..... G10D 9/06

[52] U.S. Cl. ..... 84/400; 84/453; 181/131; 181/197

[58] Field of Search ..... 84/400, 453; 181/130, 181/131, 132, 133, 134, 135, 136, 137, 185, 186, 196, 197, 206

[56] References Cited

U.S. PATENT DOCUMENTS 3,830,334 8/1974 Costa ..... 181/131

4,226,162 10/1980 Ebach ..... 84/400

*Primary Examiner*—Michael L. Gellner
*Assistant Examiner*—Cassandra C. Spyrou
*Attorney, Agent, or Firm*—James F. Weiler

[57] ABSTRACT

Disclosed is an acoustic practice mute for brass musical wind instruments having a bell end which is of simple construction, light weight, acoustically transmits muted or dampened sound to the ears of the player without any electrical or membrane amplification, in which the sound transmitted is not distorted or changed from a natural sound, in which the volume of sound to the player's ears can be regulated, and which can be used by the player as a normal mute.

12 Claims, 2 Drawing Sheets

ACOUSTIC PRACTICE MUTE

FIELD OF THE INVENTION

The present invention relates to practice mutes for brass musical wind instruments having a bell.

BACKGROUND OF THE INVENTION

Due to the high intensity sound produced by brass musical wind instruments, in many instances, difficulties are encountered when practicing with such instruments. The instrument player must find a practice room or area so that other persons are not disturbed by the sounds caused by practicing. A number of devices have been proposed to attenuate or dampen the sound of these instruments.

U.S. Pat. No. 3,392,619 illustrates a sound attenuator device for a wind instrument formed of soft plastic material providing a closed end chamber with sound attenuating material therewithin.

U.S. Pat. No. 3,555,956 illustrates an acoustical-electrical transducer for brass wind instruments which has a double wall mute having a long, narrow, highly acoustically attenuating path leading to the surrounding atmosphere for transmitting air flow of the instrument to the surrounding atmosphere.

U.S. Pat. No. 4,112,809 discloses a stringed instrument for training purposes, the sounds of the strings being transmitted to the ears of the user by a listening device.

U.S. Pat. No. 4,226,162 discloses an attachment for a musical wind instrument, such as a trumpet or the like which has a bell type end, having a hollow body and a stethoscope with a membrane and two earpieces, and in which the internal volume of the body is filled with air permeable acoustically damping material the transmitted sound being produced by the membrane.

U.S. Pat. No. 2,318,535 discloses a mute having an inner chamber and an outer chamber, a conduit disposed in the inner chamber communicating with the outer chamber through sound absorbing means associated with the outlet means.

The foregoing mutes are heavy, bulky, cumbersome, expensive, and do not produce a true and unchanged sound of the wind instrument. Also, none of these attachments or mutes can be used as a regular mute rather than as a practice mute.

SUMMARY OF THE INVENTION

The present invention is directed to an acoustic practice mute for brass musical wind instruments having a bell end which is lightweight, of simple construction, does not appreciably change the normal sound of the instrument, one in which the sound is directly transmitted without amplification or modification to the ears of the player, in which the volume of the sound to the player can be easily regulated, which does not utilize any amplifying means or membranes, and which is readily and easily manufactured at relatively low cost.

The acoustic practice mute of the present invention has a hollow body with a side wall, preferably a truncated cone, with a sound entry opening at the truncated end of the cone, a closed base end having a sound outlet opening, a sound conduit having a sound passage attached to the base end extending inwardly from the base end a distance short of the sound entry opening and providing an unobstructed sound passage throughout its length and out the sound outlet opening, the sound entry opening, sound passage of the sound conduit, and sound outlet opening being in axial alignment. Means are provided for sealingly connecting the body to the bell end of the brass musical wind instrument adjacent the sound entry opening. An acoustic or sound transmission tube extends from the interior of the body to its exterior and includes at least one and preferably two exterior tubes and two earpieces adapted to be placed into the ears of a player of the instrument. Sound adsorption means are provided in the body between the sound conduit and the side wall. Sound enters from the bell end of the instrument into the body, is dampened, then passes through the sound conduit and out the sound outlet opening and through the acoustic tube to the earpieces.

Preferably a volume control valve is provided in the exterior portion of the acoustic tube to regulate the sound volume to the earpieces. Also, preferably, the exterior portion of the acoustic tube is detachably connected to the interior portion of the acoustic tube so that the mute can be used in a normal manner, and not for attenuating or dampening sound. Preferably, the inner end of the acoustic tube is disposed adjacent the interior end of the conduit and opens in the direction of sound entering the mute.

It is an object of the present invention to provide an acoustic brass mute for brass musical wind instruments having a bell which significantly reduces the sound level and one that utilizes nonelectric acoustic transmission of sound to allow the player to hear natural and undistorted sound.

It is yet a further object of the present invention to provide such a practice mute which permits brass wind musicians to practice freely at times and/or locations previously discouraged for practice and lets the player accurately gauge the volume level so as to avoid the inefficient and often destructive over-exertion common to the use of existing practice mutes.

DESCRIPTION OF PREFERRED EMBODIMENT

Figure 1:
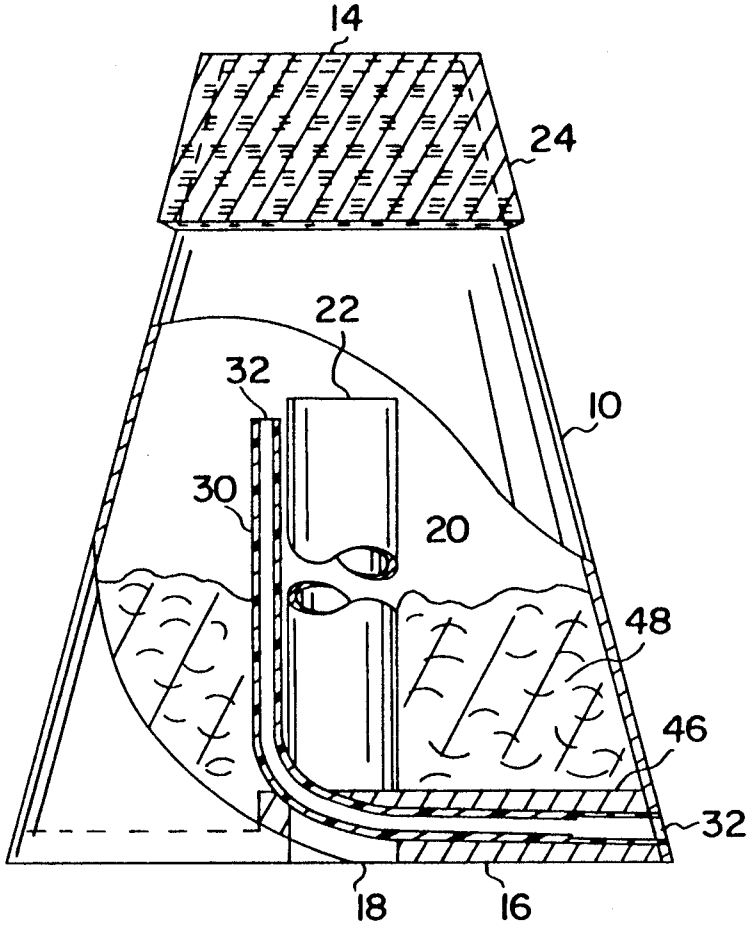
FIG. 1 depicts a cut away illustration of the body of the acoustic practice mute.
Figure 2:
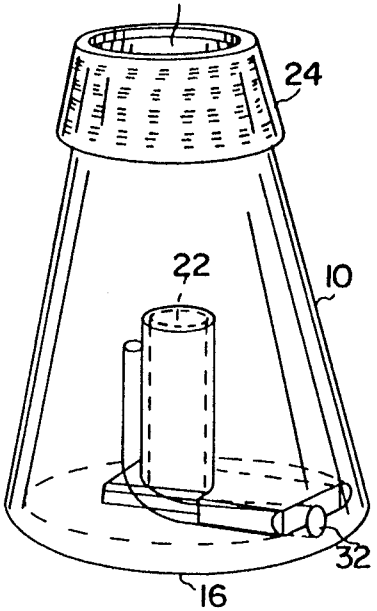
FIG. 2 illustrates the body of the acoustic practice mute.

Referring now to the drawings, and particularly to FIGS. 1 and 2, the acoustic practice mute has a body 10, a side wall 12, a sound entry opening 14 at one end and a closed base end 16 having a sound outlet 18. An acoustic conduit 20 is attached to the base end 16 and has the sound passageway 22 aligned with the sound outlet 18 in the base end 16 and the sound entry opening 14 to provide an unobstructed passage of sound entering the body 10 at its sound entry opening 14 through the sound passageway 22 in the conduit 20 and out the opening 18 in the base end 16. Preferably, the body 12 is a single wall, truncated cone although it can be of any desired shape, such as a bucket type mute shape and the like.

Figure 4:
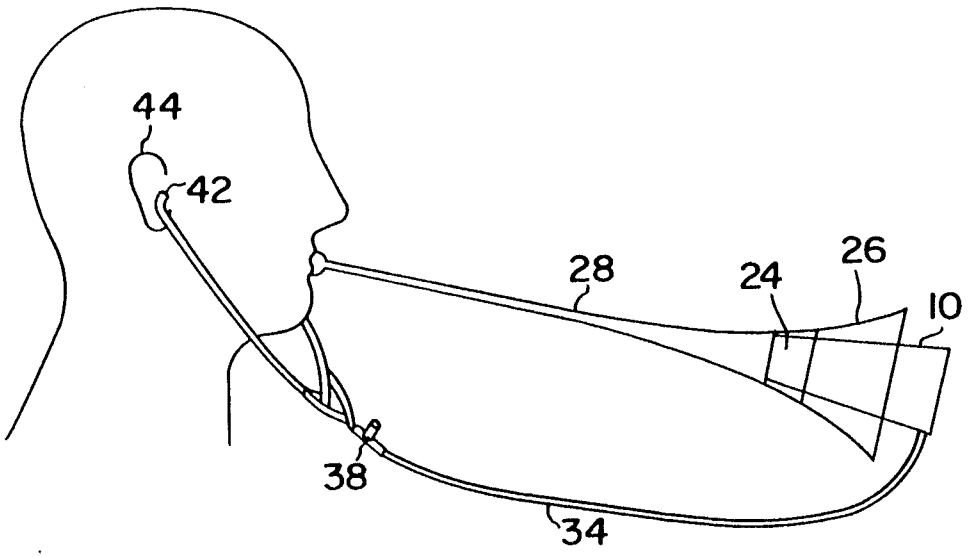
FIG. 4 illustrates the acoustic practice mute sealingly secured to a musical instrument.

Means 24 are provided for sealingly securing the body 12 to the bell end 26 of the brass musical wind instrument 28 diagrammatically illustrated in FIG. 4 as a trumpet. The means for sealingly connecting the body 12 to the bell end 26 of the brass musical instrument 28 is preferably formed of a compressible cork or rubber material which provides for simply pressing the means 24 into the bell end 26. This has less potential for instrument bell damage as only a compressible material touches the bell 26 of instrument 28. Any desired means of connecting the body 10 to the bell 26 of the wind instrument, however, can be utilized such as illustrated in the patents previously set forth.

An acoustic or sound transmission tube 30 is disposed in the interior of the body 10 and, preferably, has its open sound entry end 32 in close relationship to the sound conduit 20 and opening in the direction of incoming sound and airflow into the body 10. Preferably, the interior portion of the acoustic tube 30 is connected through an aperture 32 to an exterior portion 34 of the acoustic tube by a male or sleeve connector 36 that provides a detachable connection so that the interior portion 30 and the exterior portion 34 can be detached and the acoustic mute used as a conventional mute.

Figure 3:
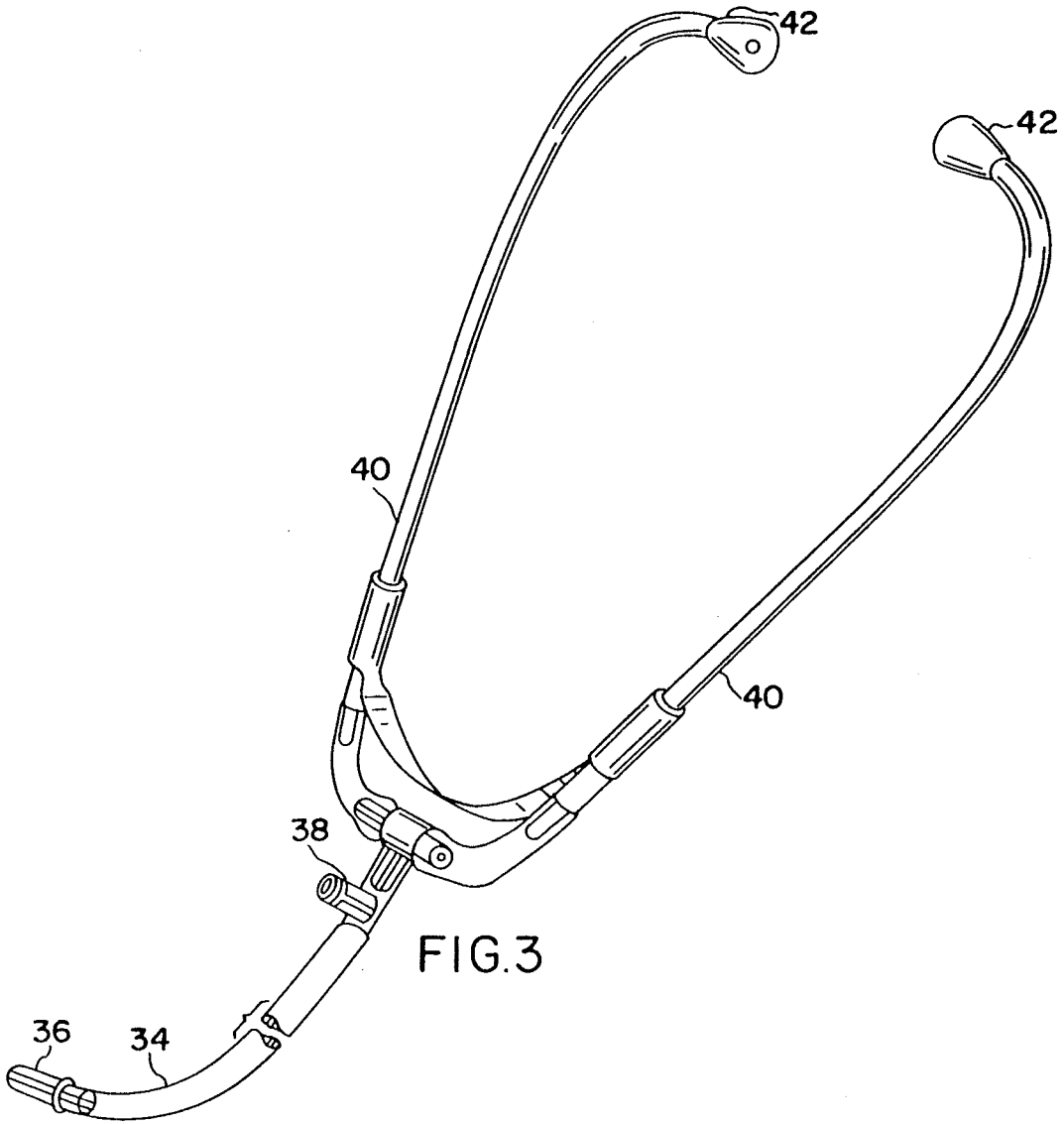
FIG. 3 illustrates the acoustic tubes of the acoustic practice mute.

Disposed in the exterior tube 34 is a valve 38, such as a needle or gage valve, which controls the flow of air, and hence the volume of sound in the tubes 40 which terminate in earpieces 42 which are placed in the ears 44 of the player of the musical brass wind instrument 28. No description of the valve 38 is given since valves of this type which are suitable are readily available on the market. As shown in FIG. 3, the acoustic tubes 30, 34, and 40 may be a stethoscope without a membrane, but simply is connected by the connector 36 to the interior portion of the acoustic tube 30 in the interior of the body 10.

As shown in FIGS. 1 and 2, suitable bracing 46 adjacent the base end 16 of the body 10 is provided to support the flexible acoustic tube 30 in position and which tube 30 is secured to the sound conduit 20 by any suitable means, not shown.

As best illustrated in FIG. 1, sound adsorption material 48, such as air acoustic foam, fibrous wadding and the like are provided inside of the mute to dampen and reduce the sound.

In use, and referring to FIG. 4, the sealing means 24 of the body 10 of the acoustic mute is placed in the bell 26 of the brass wind instrument 28 until the body 10 is firmly and sealingly secured as illustrated. The earpieces 42 are placed in the ears 44 and the player blows through the musical instrument 28, a natural and undistorted muted sound passing to the earpieces 42 and to the ears 44 of the player. The volume of air and hence the sound is regulated by the control valve 38 so that the sound will be at a comfortable level for the player. The sound enters the sound entry 14 in the body 12, passes through the sound conduit 20 and out the sound outlet 18 in the mute, the volume and hence the intensity of the sound being substantially reduced. The sound also enters the acoustic tube 30 through its opening 32, passes in the tubes 34 and 40 to the earpieces 42. The sound has a natural and undistorted sound as a player playing the musical instrument. If it is desired that the mute be utilized in a normal manner and not as a practice mute, the tube 34 can be removed by detaching the acoustic tube 34 from the connector 36 in the aperture 32 in the body 10 of the mute.

While the mute has been described and illustrated for use with a trumpet, it may be used with all musical brass instruments having a bell end, such as cornets, trumpets, trombones, French horns, euphoniums, tubas, and the like.

The present invention therefore is well suited and adapted to attain the objects and ends and has the advantages and features mentioned. While presently preferred embodiments of the invention have been given for the purpose of disclosure, changes can be made therein which are within the spirit of the invention as defined by the scope of the appended claims.

What is claimed is:

1. An acoustic practice mute for a brass musical wind instrument having a bell end comprising, a hollow body having a side wall, a sound entry opening at one end and a closed base end having a sound outlet opening, a sound conduit attached to the base end having a sound passage aligned with the sound entry and sound outlet openings and extending inwardly in the body from the base end short of the sound entry opening providing an unobstructed sound passage from the sound entry opening throughout the sound conduit and out the sound outlet opening, means adjacent the sound entry opening on the body for sealingly connecting the body to the bell end, an acoustic tube disposed within the body extending exteriorly of the body and including at least one earpiece adapted to be placed in an ear of a player of the brass musical wind instrument, sound adsorption material in the body between the sound conduit and the side wall, whereby sound from the bell end enters the body throughout the sound entry, is dampened, and then passes through the sound conduit, out the sound outlet opening, and through the acoustic tube to the earpiece.

2. The acoustic practice mute of claim 1 including, a volume control valve in the acoustic tube exteriorly of the body operable to regulate the volume of the sound to the earpiece.

3. The acoustic practice mute of claim 1 where, the acoustic tube exterior of the body comprises a pair of tubes each having an earpiece.

4. The acoustic practice mute of claim 1 including, a volume control valve in the acoustic tube exteriorly of the body operable to regulate the volume of the sound transmitted thereby, and a pair of acoustic tubes each with an earpiece extending from the acoustic tube.

5. The acoustic practice mute of claim 1 where, the body comprises a truncated cone, its small end having the sound entry opening and its large end the closed base, and the means for sealingly connecting the body to the bell end is disposed about the body adjacent the sound entry opening for sealingly securing the body within the interior of the bell end.

6. The acoustic practice mute of claim 1 where, the acoustic tube comprises an inner portion and an exterior portion detachably connected adjacent the side wall.

7. The acoustic practice mute of claim 1 where, the acoustic tube's interior end is disposed adjacent the interior end of the sound conduit and opens in the direction of sound from the sound entry opening.

8. The acoustic practice mute of claim 5 where, the side wall is a single wall.

9. An acoustic practice mute for a brass musical wind instrument having a bell end comprising, a truncated cone having a side wall, an open small end comprising a sound entry opening and a closed base end having a sound outlet opening, a sound conduit having a sound passage aligned with the sound entry and sound outlet openings extending inwardly from the base having its inner end short of the sound entry opening providing an unobstructed sound passage from the sound opening throughout the sound conduit and out the sound outlet opening, compressible sealing and securing means disposed about the small end of the truncated cone operable to sealingly secure the truncated cone to the bell end, an acoustic tube transmitting sound from the brass musical instrument having an interior portion disposed in the truncated cone and an exterior portion disposed externally thereof, means detachably connecting the interior and exterior portions adjacent the side wall of the truncated cone, the exterior portion of the acoustic tube including a pair of acoustic tubes, and an earpiece at each end of the pair of acoustic tubes whereby sound from the bell end enters the truncated cone through the sound entry opening, is dampened and then passes through the sound conduit and out the sound outlet opening, and through the acoustic tube to the earpieces.

10. The acoustic practice mute of claim 9 where, the external portion of the acoustic tube has a volume control valve operable to regulate the volume of the sound to the earpieces.

11. The acoustic practice mute of claim 9 where, the side wall of the truncated cone is a single wall.

12. The acoustic practice mute of claim 9 where, the interior portion of the acoustic tube is disposed adjacent the inner end of the sound conduit and opening in the direction of sound from the sound entry opening.

* * * * *

UNITED STATES PATENT OFFICE

CERTIFICATE OF CORRECTION

Patent No. 5,309,808 Dated May 10, 1994

Inventor(s) James Kevin Tarrant

It is certified that error appears in the above-identified patent and that said Letters Patent is hereby corrected as shown below:

The following paragraphs are added at column 2 after line 39:

It is a further object of the present invention to provide such a practice mute which has an unobstructed path through the mute for release of the air used to sound the instrument, a hollow acoustic or sound pick up tube which transfers such sound from the instrument within the mute to outside the mute utilizing earpieces for transfer of the sound to the ears of the player.

It is yet a further object of the present invention to provide a simple air control valve which controls the air/volume of the sound to the earpieces and thus to the player's ears.

It is a further object of the present invention to provide such a practice mute which is acoustic, which does not utilize electric or membrane amplification to hear the sound and in which the natural sound of a nonpractice mute is not distorted or changed by the practice mute.

It is still a further object of the present invention to provide such a practice mute which is of simple construction, one which can be secured to the inside of the bell of the instrument which has less potential for damage to the bell of the instrument, and which uses a single chamber.

UNITED STATES PATENT AND TRADEMARK OFFICE

CERTIFICATE OF CORRECTION

PATENT NO. : 5,309,808
DATED : May 10, 1994
INVENTOR(S) : James Kevin Tarrant

It is certified that error appears in the above-indentified patent and that said Letters Patent is hereby corrected as shown below:

Other and further objects, features, and advantages of the practice mute of the present invention appear throughout the specification and claims and are inherent therein.

Signed and Sealed this

Fourteenth Day of February, 1995

*Attest:*

Bruce Lehman

BRUCE LEHMAN

*Attesting Officer*

*Commissioner of Patents and Trademarks*